US007938595B2

(12) United States Patent
Potts et al.

(10) Patent No.: US 7,938,595 B2
(45) Date of Patent: May 10, 2011

(54) SURFACE COMPACTOR AND METHOD OF OPERATING A SURFACE COMPACTOR

(75) Inventors: Dean Roger Potts, Maple Grove, MN (US); Mario Joseph Souraty, Plymouth, MN (US); Nicholas A. Oetken, Maple Grove, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 863 days.

(21) Appl. No.: 11/797,027

(22) Filed: Apr. 30, 2007

(65) Prior Publication Data

US 2008/0267707 A1 Oct. 30, 2008

(51) Int. Cl.
*E01C 23/07* (2006.01)

(52) U.S. Cl. ..... 404/84.1

(58) Field of Classification Search ..... 404/84.05, 404/84.1, 133.05

See application file for complete search history.

(56) References Cited

U.S. PATENT DOCUMENTS

| | | | | |
|---|---|---|---|---|
| 4,330,738 | A | 5/1982 | Paramythioti et al. | |
| 5,164,641 | A | 11/1992 | Quibel et al. | |
| 5,618,133 | A | 4/1997 | Mitsui et al. | |
| 5,695,298 | A | 12/1997 | Sandström | |
| 5,727,900 | A | 3/1998 | Sandström | |
| 6,431,790 | B1 | 8/2002 | Anderegg et al. | |
| 6,551,020 | B2 | 4/2003 | Swanson et al. | |
| 6,558,072 | B2 | 5/2003 | Staffenhagen et al. | |
| 6,637,280 | B2 | 10/2003 | Potts | |
| 6,750,621 | B2 * | 6/2004 | Gandrud | 318/114 |
| 6,769,838 | B2 | 8/2004 | Potts | |
| 7,089,823 | B2 | 8/2006 | Potts | |
| 7,168,885 | B2 * | 1/2007 | Rio et al. | 404/72 |
| 2004/0009039 | A1 * | 1/2004 | Corcoran et al. | 404/117 |
| 2004/0101367 | A1 * | 5/2004 | Riedl | 404/113 |
| 2006/0034657 | A1 | 2/2006 | John Rio et al. | |
| 2006/0147265 | A1 * | 7/2006 | Fluent et al. | 404/117 |
| 2008/0003057 | A1 * | 1/2008 | Hall et al. | 404/84.1 |

* cited by examiner

*Primary Examiner* — Gary S Hartmann
(74) *Attorney, Agent, or Firm* — Miller, Matthias & Hull

(57) ABSTRACT

A method of operating a surface compactor is provided. The method may include supporting a base of the surface compactor on a surface. The method may also include generating a fluctuating vertical force on the base with a vibratory mechanism, which may include moving one or more weights of the vibratory mechanism with a drive system of the vibratory mechanism. Additionally, the method may include sensing a parameter of the operation of the vibratory mechanism that fluctuates in reaction to moving the one or more weights to generate the fluctuating vertical force. The method may also include automatically adjusting the operation of the vibratory mechanism to adjust the fluctuating vertical force based at least in part on the sensed parameter.

7 Claims, 7 Drawing Sheets

SURFACE COMPACTOR AND METHOD OF OPERATING A SURFACE COMPACTOR

TECHNICAL FIELD

The present disclosure relates to surface compactors and, more particularly, surface compactors that include at least one vibratory mechanism for generating a fluctuating vertical force on a base of the surface compactor to enhance compaction of the surface underlying the base.

BACKGROUND

Many projects require compacting a surface. For example various types of construction projects may require compacting surfaces formed by substances like soil, gravel, and asphalt. Various types of specialized machines exist for compacting such surfaces, including, but not limited to, surface rollers and vibrating plates. Such surface compactors operate by applying downward force on the surface with a base of the surface compactor, which base may include, for example, one or more rollers and/or one or more plates.

Some surface compactors include a vibratory mechanism for generating a fluctuating vertical force on the base of the surface compactor to enhance surface compaction. The results achieved by such a surface compactor may depend in part on the amplitude of the fluctuating vertical force generated by the vibratory mechanism. Accordingly, there exist various control methods for adjusting the magnitude of the fluctuating vertical force to achieve different results. Unfortunately, the effect of any particular amplitude of the fluctuating vertical force may also depend on various other factors, such as the hardness of the surface underlying the base. Thus, due to variations in operating conditions, a control method that involves adjusting the amplitude of the fluctuating vertical force without some type of feedback related to the effect of the fluctuating vertical force may fail to achieve the desired results.

U.S. Pat. No. 5,695,298 to Sandstrom ("the '298 patent") discloses using an accelerometer to provide feedback for a method of controlling the amplitude of a fluctuating vertical force used to vibrate a roller. Inside the roller of the machine disclosed in the '298 patent, a rotating weight generates a fluctuating vertical force, thereby exciting vibration of the roller. The accelerometer mounts to a frame that attaches to the vibrating roller. The control method of the '298 patent involves processing the signal from the accelerometer and adjusting the magnitude of the fluctuating vertical force in response to certain operating conditions indicated by the signal.

Although the '298 patent discloses a control method that uses feedback about the actual effect of the fluctuating vertical force on the vibrating roller when adjusting the magnitude of the fluctuating vertical force, certain disadvantages persist. For example, accelerometers robust enough to survive in such an application for an extended period of time are typically relatively expensive.

The surface compactor and methods of the present disclosure solve one or more of the problems set forth above.

SUMMARY OF THE INVENTION

One disclosed embodiment relates to a method of operating a surface compactor. The method may include supporting a base of the surface compactor on a surface. The method may also include generating a fluctuating vertical force on the base with a vibratory mechanism, which may include moving one or more weights of the vibratory mechanism with a drive system of the vibratory mechanism. Additionally, the method may include sensing a parameter of the operation of the vibratory mechanism that fluctuates in reaction to moving the one or more weights to generate the fluctuating vertical force. The method may also include automatically adjusting the operation of the vibratory mechanism to adjust the fluctuating vertical force based at least in part on the sensed parameter.

Another embodiment relates to a surface compactor that includes a base. The surface compactor may also include a vibratory mechanism, which may include a drive system that moves one or more weights in a manner that generates a fluctuating vertical force on the base. Additionally, the surface compactor may include a control system. The control system may sense a load in the surface compactor that fluctuates in reaction to the drive system moving the one or more weights and generating the fluctuating vertical force. The control system may also adjust the operation of the vibratory mechanism to adjust the fluctuating vertical force based at least in part on the sensed load.

A further embodiment relates to a method of operating a surface compactor. The method may include supporting a base of the surface compactor on a surface. The method may also include generating a fluctuating vertical force on the base with a vibratory mechanism, which may include moving one or more weights of the vibratory mechanism with a drive system of the vibratory mechanism. Additionally, the method may include sensing a load on an actuator of the drive system of the vibratory mechanism. The method may also include adjusting the operation of the vibratory mechanism to reduce the magnitude of the fluctuating vertical force in response to the sensed load fluctuating by an amount greater than a reference value.

DETAILED DESCRIPTION

Figure 1A:
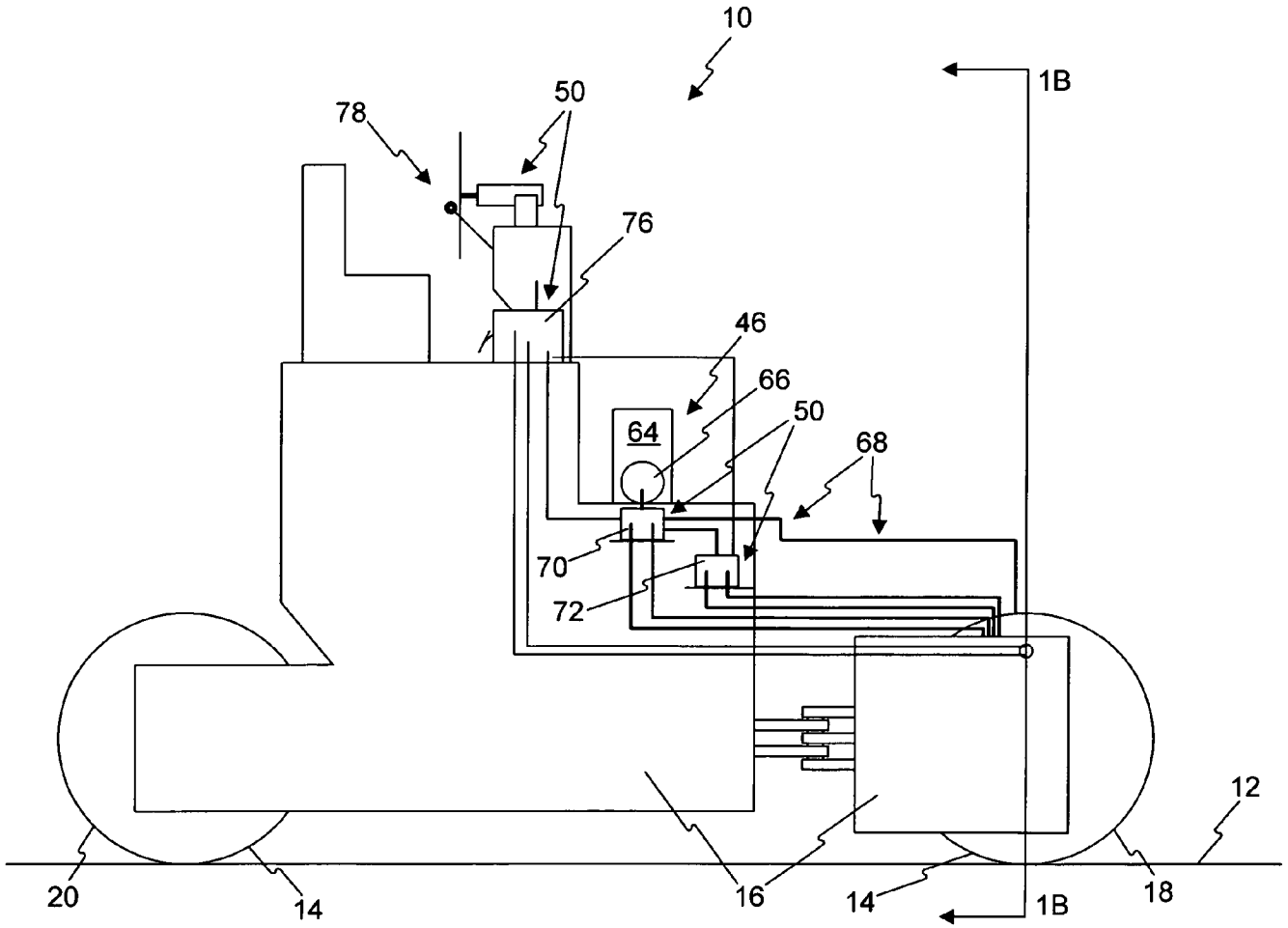
FIG. 1A illustrates one embodiment of a surface compactor according to the present disclosure.

FIGS. 1A-1E illustrate a surface compactor 10 according to the present disclosure supported on a surface 12. Surface compactor 10 may have a base 14 that rests on surface 12. Suspended from base 14, surface compactor 10 may include a frame 16, a vibratory mechanism 28 (shown in FIGS. 1B-1E), a power system 46, a propulsion system 48 (shown in FIG. 1B), and a control system 50.

Figure 1B:
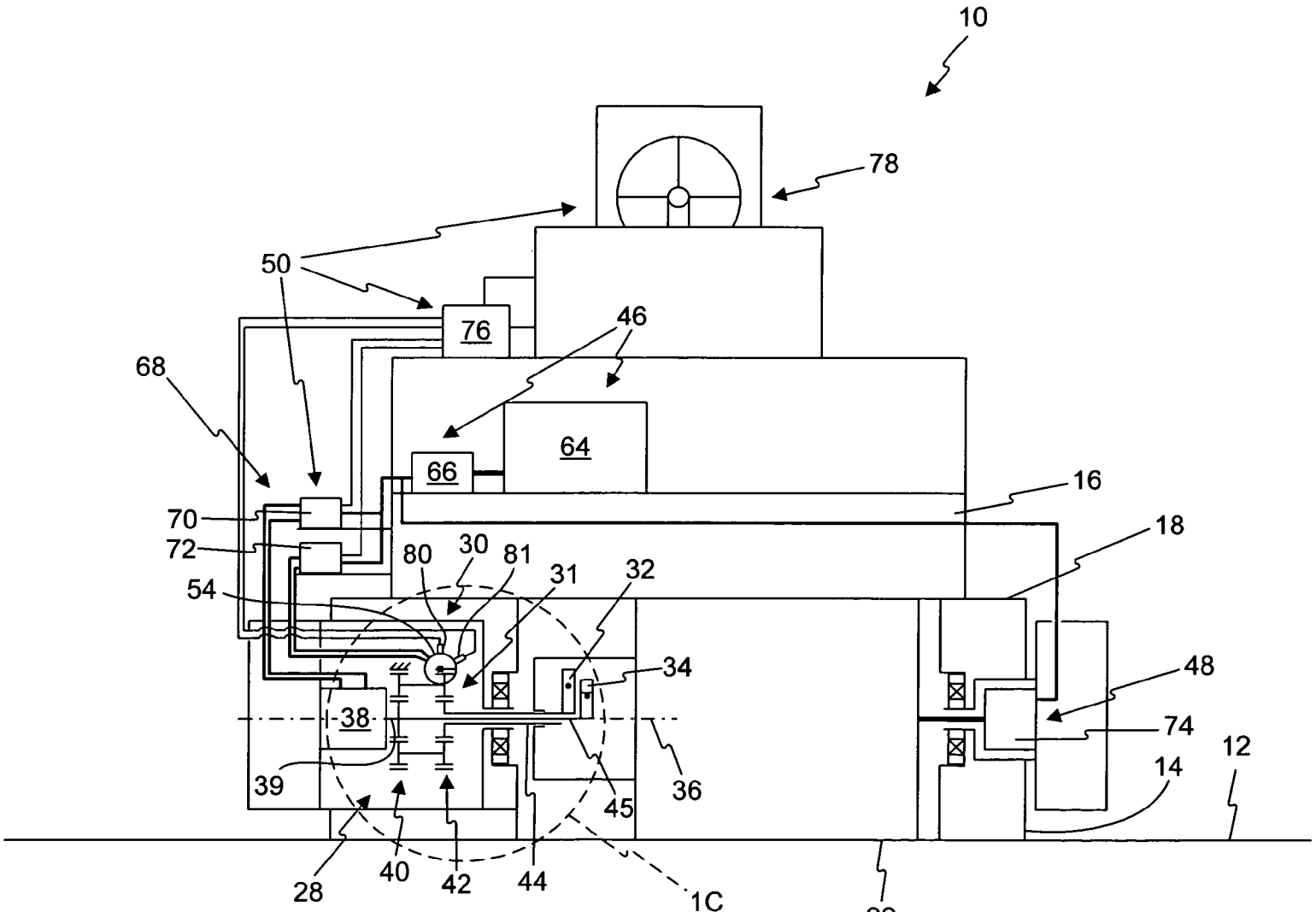
FIG. 1B is a sectional view through line 1B-1B of FIG. 1A.
Figure 1C:
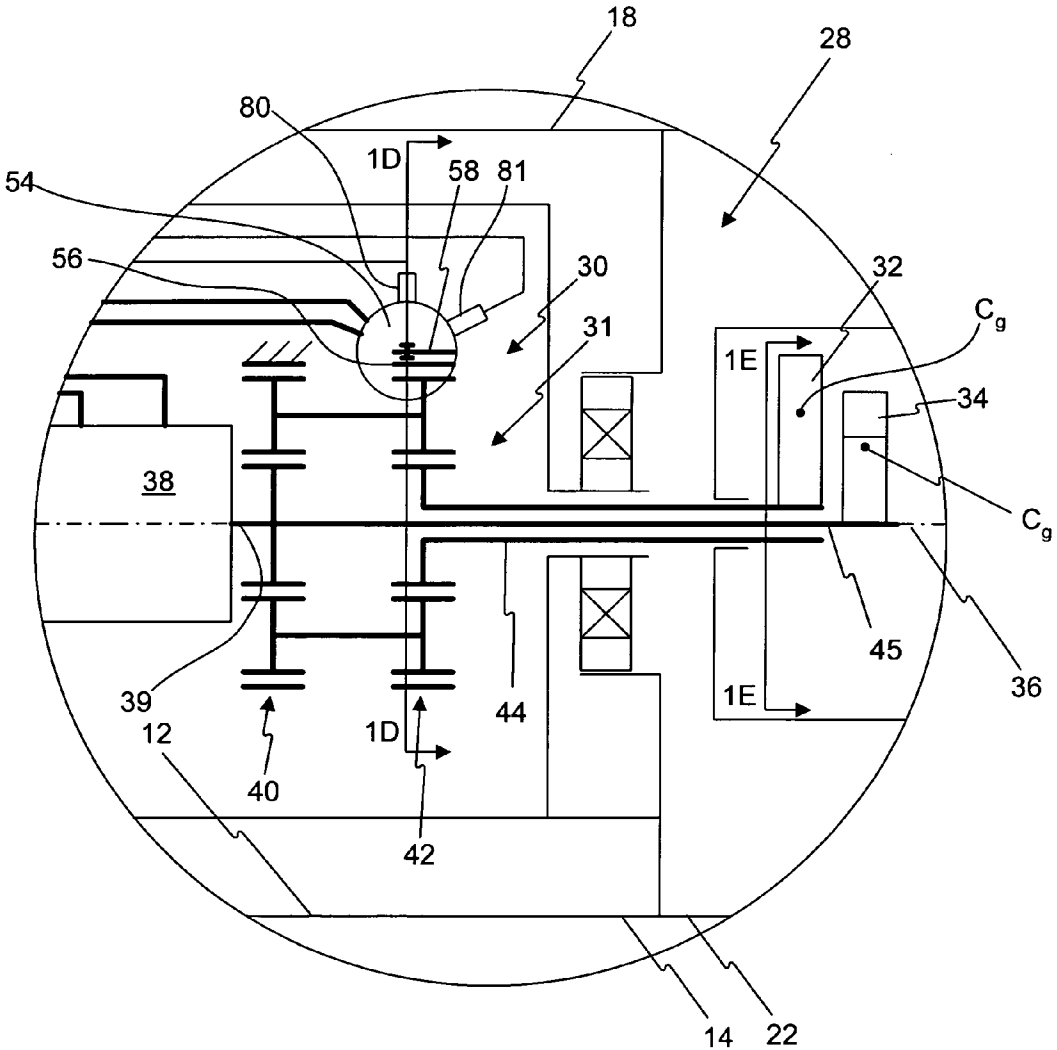
FIG. 1C is an enlarged view of the portion of FIG. 1B shown in circle 1C.

Base 14 may include one or more components of various configurations. In some embodiments, base 14 may include one or more rollers, such as a roller 18 and a roller 20. One or more of the components of base 14 may have a coated or uncoated metal surface with a substantially straight profile that contacts surface 12. For example, as FIGS. 1B and 1C show, roller 18 may have a coated or uncoated metal surface 22 with a straight profile that rests on surface 12.

Frame 16 may link and/or support one or more components of surface compactor 10 together. For example, as FIG. 1A shows, frame 16 may link rollers 18, 20. Additionally, frame 16 may support one or more components of vibratory mechanism 28, power system 46, propulsion system 48, and control system 50. Frame 16 may connect to each roller 18, 20 in a manner that allows each roller 18, 20 to rotate around its longitudinal axis.

Vibratory mechanism 28 may include a drive system 30 and one or more weights that drive system 30 moves in a manner to generate a fluctuating vertical force on base 14. For example, as FIG. 1B shows, vibratory mechanism 28 may include a weight 32 and a weight 34, and drive system 30 may include one or more components configured to rotate weights 32, 34 around an axis 36 spaced from the center of gravity $C_g$ of each weight 32, 34. In some embodiments, for rotating weights 32, 34 around axis 36, drive system 30 may have an actuator 38 with a rotary output member 39 drivingly connected to weight 32 and weight 34. Actuator 38 may be, for example, a fluid-operated motor, such as a hydraulic motor, or an electric motor.

Drive system 30 may have the same drive ratio between rotary output member 39 and weight 32 as between rotary output member 39 and weight 34. Drive system 30 may include a drive train 31 that connects rotary output member 39 to weight 32 at a 1:1 drive ratio. Drive train 31 may include a planetary gear set 40, a planetary gear set 42, and a rotary drive member 44 connected in series between rotary output member 39 and weight 32. Drive system 30 may also include a rotary drive member 45 connecting rotary output member 39 to weight 34 at a 1:1 drive ratio. As FIGS. 1B-1E show, rotary drive member 45 may extend through the center of rotary drive member 44.

In some embodiments and/or circumstances, in addition to providing equal drive ratios, the connections between rotary drive member 39 and weights 32, 34 may provide one angular relationship between rotary output member 39 and weight 32 and a different angular relationship between rotary output member 39 and weight 34. As FIG. 1E shows, this may result in an angle 52 around axis 36 between the center of gravity $C_g$ of weight 32 and the center of gravity $C_g$ of weight 34.

Drive system 30 may include provisions for controlling angle 52. For example, drive system 30 may include an actuator 54 drivingly connected to a ring gear 56 of planetary gear set 42 in a manner allowing actuator 54 to control the rotary position of ring gear 56. In some embodiments, actuator 54 may be a linear fluid-operated actuator, such as a hydraulic cylinder. Actuator 54 may include a cylinder 55, a piston 57 disposed inside cylinder 55, and a drive member 59 extending from piston 57 out of cylinder 55. Piston 57 may divide the inside of cylinder 55 into a chamber 65 and a chamber 67. Control system 50 may activate actuator 54 to move drive member 59 in a direction 60 by increasing fluid pressure in chamber 65 and/or decreasing fluid pressure in chamber 67. Similarly, control system 50 may activate actuator 54 to move drive member 59 in an opposite direction 61 by increasing fluid pressure in chamber 67 and/or decreasing fluid pressure in chamber 65.

Figure 1D:
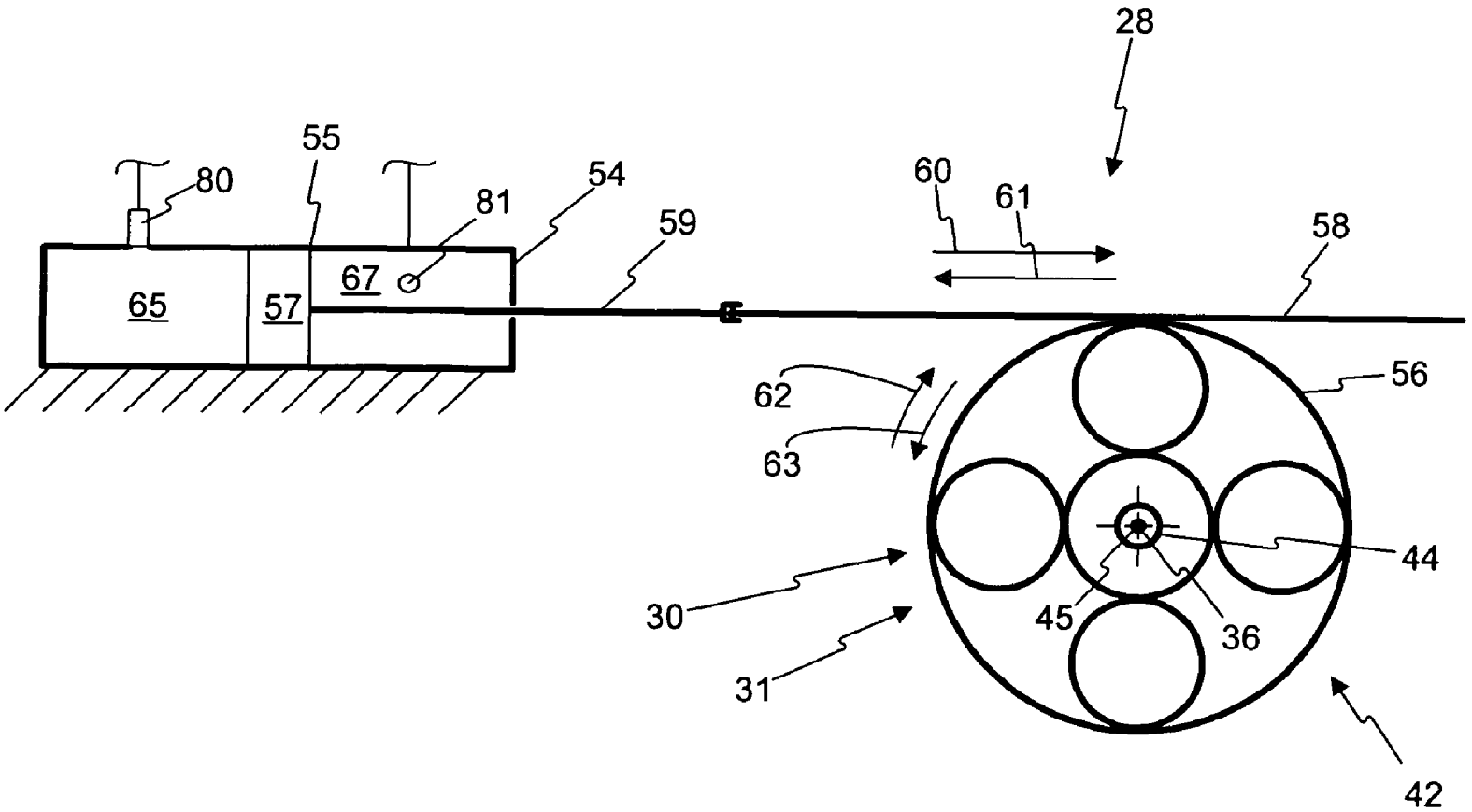
FIG. 1D is a sectional view through line 1D-1D of FIG. 1C.
Figure 1E:
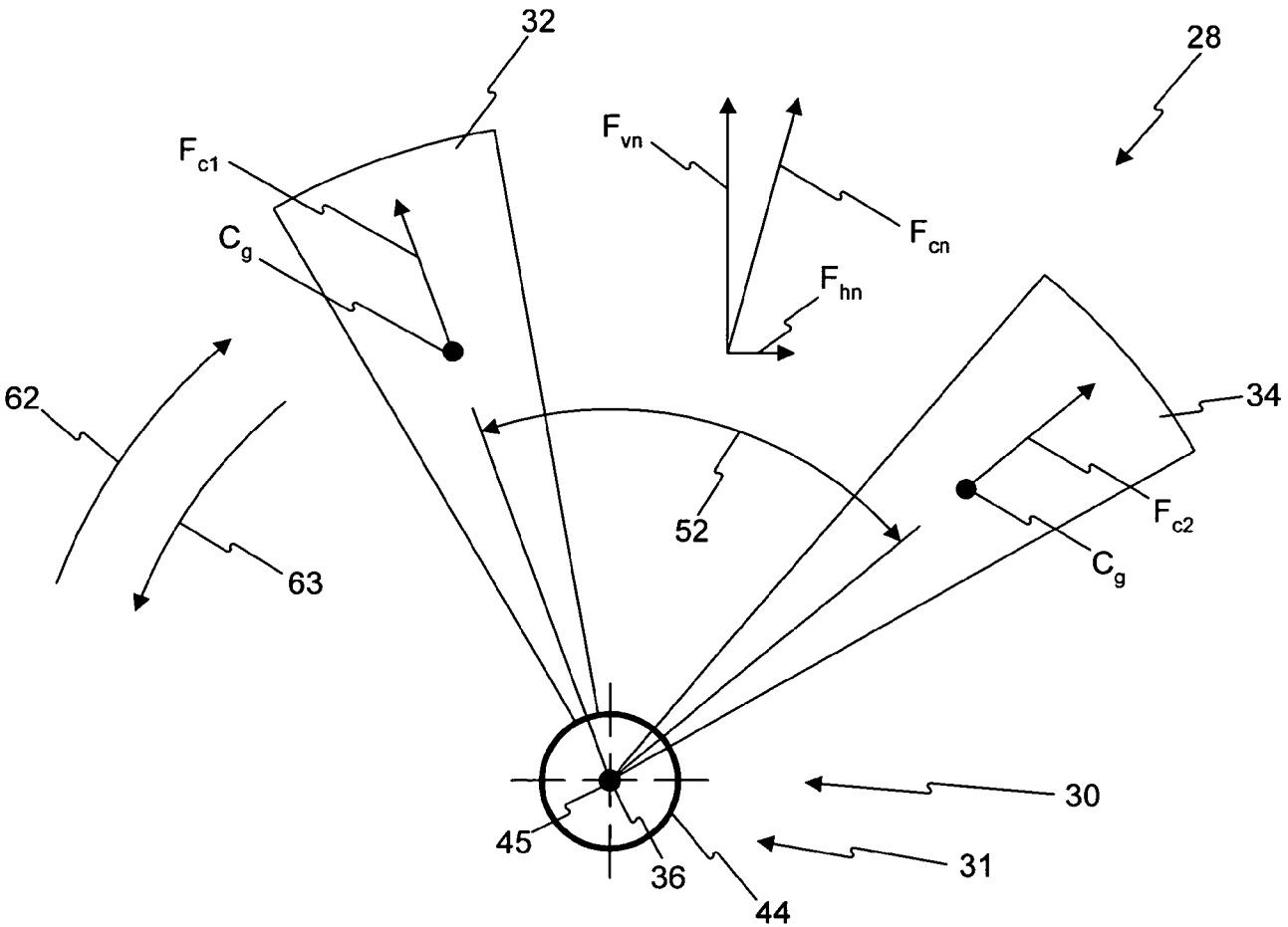
FIG. 1E is a sectional view through line 1E-1E of FIG. 1C.

As best shown in FIG. 1D, drive member 59 may connect to a rack 58 that engages ring gear 56 through gear teeth (not shown). When not activated, actuator 54 may hold ring gear 56 in a fixed position. With the position of ring gear 56 fixed and rotary output member 39 connected to weights 32, 34 at equal drive ratios, the magnitude of angle 52 may remain fixed, and actuator 38 may rotate weights 32, 34 around axis 36 in the same direction and at the same speed.

When activated, actuator 54 may drive rack 58 in direction 60 or direction 61, thereby rotating ring gear 56 in a direction 62 or a direction 63. Rotating ring gear 56 in direction 62 with actuator 54 may rotate weight 32 in direction 62 relative to weight 34, thereby decreasing angle 52. Similarly, rotating ring gear 56 in direction 63 with actuator 54 may rotate weight 32 in direction 63 relative to weight 34, thereby increasing angle 52.

Vibratory mechanism 28 may mount in various locations on surface compactor 10. As FIGS. 1B-1E show, in some embodiments, one or more portions of vibratory mechanism 28 may mount inside roller 18.

The configuration of vibratory mechanism 28 is not limited to the examples discussed above. Drive system 30 may include different types and/or arrangements of components for connecting actuators 38, 54 to weights 32, 34. Additionally, drive system 30 may have a different number and/or different types of actuators than discussed above. For example, the actuators for moving weights 32, 34 may include a first hydraulic motor for moving one of weights 32, 34 and a second hydraulic motor for moving the other of weights 32, 34. In such an embodiment, the first and second hydraulic motors may be hydraulically connected in series, such that hydraulic fluid flows to the first hydraulic motor first and then to the second hydraulic motor. Furthermore, in addition to, or instead of, rotating weights 32, 34 around axis 36 to generate fluctuating vertical force, drive system 30 may move one or more weights in a different manner to generate fluctuating vertical force. For example, drive system 30 may generate fluctuating vertical force by linearly oscillating one or more weights.

Power system 46 may include one or more components for supplying power in a form that drive system 30 can use to control the motion of weights 32, 34. For example, as FIG. 1B shows, power system 46 may include a power source 64, such as an engine, a power-conversion unit 66. Power source 64 may supply mechanical power and power-conversion unit 66 may convert mechanical power from power source 64 into a form useable by actuators 38, 54. In embodiments where actuators 38, 54 use fluid power, power-conversion unit 66 may be a pump. Similarly, in embodiments where actuators 38, 54 use electricity, power-conversion unit 66 may be an electric generator.

Power system 46 may include a power-transfer system 68 for supplying power from power-conversion unit 66 to actuators 38, 54. In embodiments where actuators 38, 54 use fluid power, power-transfer system 68 may include plumbing for supplying fluid to and/or from actuators 38, 54. Similarly, in embodiments where actuators 38, 54 use electricity, power-transfer system 68 may include one or more circuits for supplying electricity to actuators 38, 54. Power-transfer system 68 may include power-flow regulators 70, 72, such as valves or electric current regulators, for regulating the flow of power to actuators 38, 54.

Power system 46 is not limited to the configuration shown in FIG. 1B. For example, power system 46 may have different numbers and/or arrangements of components than discussed above. In some embodiments, actuator 38 and actuator 54 may use different types of power, and power system 46 may include different components for supplying power to actuator 38 than for supplying power to actuator 54. Additionally, in place of power source 64, power system 46 may include components for receiving power from one or more power sources external to surface compactor 10.

Propulsion system 48 may include one or more components of power system 46 and one or more components operable to propel surface compactor 10 with power supplied by power system 46. For example, propulsion system 48 may include power source 64, power-conversion unit 66, and an actuator 74 operable to rotate roller 18 around its longitudinal axis with power from power-conversion unit 66. Actuator 74 may be, for example, a hydraulic motor or an electric motor.

Control system 50 may include any components operable to control the operation of surface compactor 10 as described hereinbelow. In some embodiments, control system 50 may include power-flow regulators 70, 72 and a controller 76. Controller 76 may include one or more processors (not shown) and one or more memory devices (not shown). Control system 50 may have a configuration that enables controller 76 to control vibratory mechanism 28. For example, control system 50 may have controller 76 may operatively connected to power-flow regulators 70, 72 so that controller 76 may control actuators 38, 54 by controlling the flow of power to them.

Control system 50 may also include various sources of information that controller 76 may use as factors in controlling vibratory mechanism 28. For example, as FIG. 1A shows, control system 50 may include an operator interface 78 that transmits signals related to operator inputs to controller 76. Additionally, control system 50 may include one or more sensors, such as a sensor 80 and a sensor 81 (FIGS. 1B-1D), that provide controller 76 with information about one or more parameters of the operation of surface compactor 10. In some embodiments, sensors 80 and 81 may be pressure sensors that sense pressure in the operating fluid in chamber 65 and chamber 67 (FIG. 1D), respectively, and supply signals indicating the sensed pressures to controller 76. Because the difference in pressure between chamber 65 and chamber 67 corresponds to the load on actuator 54, the signals supplied by sensors 80, 81 may collectively indicate the load on actuator 54 to controller 76.

Control system 50 is not limited to the examples discussed above. For example, in addition to, or in place of, controller 76 and power-flow regulators 70, 72, control system 50 may include various other control components for controlling the operation of vibratory mechanism 28 dependent on operator inputs and/or operating conditions of surface compactor 10. Additionally, sensors 80, 81 may sense the pressure of operating fluid in plumbing connected to chambers 65, 67, rather than sensing the pressure in chambers 65, 67 directly. Furthermore, control system 50 may sense the load on actuator 54 in some way other than sensing the pressure in operating fluid of actuator 54. For example, sensor 80 or sensor 81 may sense stress in a component of actuator 54 or stress in a component connected to actuator 54. Moreover, sensor 80 and/or sensor 81 may sense a load other than the load on actuator 54, such as a load on rotary drive member 45, a load in drive train 31, or a load on actuator 38. Furthermore, sensor 80 may sense a parameter of the operation of vibratory mechanism 28 other than a load, such as the instantaneous speed of one or more components of drive system 30. Additionally, in embodiments where drive system 30 includes one actuator for moving weight 32 and another actuator for moving weight 34, sensor 80 may sense a parameter related to the interaction between the two actuators. For example, in embodiments where drive system 30 includes a hydraulic motor for driving weight 32, includes a hydraulic motor for driving weight 34, and has the two hydraulic motors hydraulically connected in series, sensor 80 may sense pressure in hydraulic fluid flowing between the hydraulic motors.

Additionally, the general configuration of surface compactor 10 is not limited to the examples discussed above in connection with FIGS. 1A-1E. For example, base 14 may have a different configuration than shown in FIGS. 1A-1C. In addition to, or in place of, roller 18 and/or roller 20, base 14 may have one or more other components of various types that rest on surface 12, including, but not limited to, runners, plates, wheels, and track units. In some embodiments, a single component, such as a plate, may compose base 14. Additionally, surface compactor 10 may omit propulsion system 48.

INDUSTRIAL APPLICABILITY

Surface compactor 10 may have application for any task requiring compacting a surface 12. Downward force applied by base 14 may compact the portion of surface 12 under base 14. An operator may compact different portions of surface 12 by moving base 14 along surface 12, such as by activating propulsion system 48 to roll rollers 18, 20 along surface 12.

Vibratory mechanism 28 may help surface compactor 10 compact surface 12 more effectively by generating fluctuating vertical force on base 14. As FIG. 1E shows, when rotated around axis 36 by drive system 30, weights 32, 34 generate centrifugal forces $F_{c1}$, $F_{c2}$, which combine to form a net centrifugal force $F_{cn}$ on surface compactor 10. Net centrifugal force $F_{cn}$ may include two components: a net vertical force $F_{vn}$ and a net horizontal force $F_{hn}$. The net centrifugal force $F_{cn}$ may rotate with weights 32, 34. As a result, during each revolution of weights 32, 34, the net vertical force $F_{vn}$ may fluctuate between an upward force equal to the net centrifugal force $F_{cn}$ when net centrifugal force $F_{cn}$ points directly upward and a downward force equal to the net centrifugal force $F_{cn}$ when net centrifugal force $F_{cn}$ points downward. Thus, the net vertical force $F_{vn}$ may fluctuate at the same frequency that weights 32, 34 rotate around axis 36, hereinafter referred to as the excitation frequency. The fluctuating net vertical force $F_{vn}$ may transfer to base 14 through one or more load paths in surface compactor 10.

Control system 50 may adjust the magnitude of the net centrifugal force $F_{cn}$, and thus the amplitude of fluctuation of the net vertical force $F_{vn}$, by operating actuator 54 to adjust angle 52. Decreasing angle 52 reduces the angle between the individual centrifugal forces $F_{c1}$, $F_{c2}$ so that they add to one another to a greater extent, resulting in a larger net centrifugal force $F_{cn}$ and a larger amplitude of fluctuation of the net vertical force $F_{vn}$. Reducing angle 52 may produce the opposite effect.

Generally, increasing the amplitude of fluctuation of the net vertical force $F_{vn}$ provides more effective compaction of surface 12. However, at some point as the amplitude of fluctuation of the net vertical force $F_{vn}$ increases, the fluctuating net vertical force $F_{vn}$ may cause base 14 to separate from surface 12. For example, if its amplitude becomes large enough, the fluctuating net vertical force $F_{vn}$ may cause a behavior referred to as "double jumping." This behavior involves base 14 bouncing off of surface 12 during every other cycle of the fluctuating net vertical force $F_{vn}$ remaining in the air for a full cycle of the fluctuating net vertical force $F_{vn}$ between each bounce. In other words, during double jumping, base 14 lifts off of and falls back to surface 12 at half the excitation frequency. Double jumping may undermine the goal of compacting surface 12 because the impact each time base 14 falls back to surface 12 may pulverize the material forming surface 12.

In addition to producing the fluctuating net vertical force $F_{vn}$, rotating weights 32, 34 around axis 36 may cause one or more other parameters of the operation of surface compactor 10 to fluctuate. As drive system 30 rotates weights 32 and 34, the horizontal distance between the center of gravity $C_g$ of each weight 32, 34 and axis 36 may vary sinusoidally. As a result, the torque on drive train 31 and rotary drive system 45 from gravitational forces on weights 32, 34 may also vary sinusoidally. This may generate fluctuating loads on various components in drive system 30, including a fluctuating load on actuator 54. The fluctuating loads may cause the velocity of one or more components of drive system 30 to fluctuate. Additionally, various other parameters of the operation of drive system 30 may fluctuate in reaction to rotating weights 32, 34 around axis 36. For example, in an embodiments where actuator 38 and/or actuator 54 is an electric motor, rotating weights 32, 34 around axis 36 to generate the fluctuating net vertical force $F_{vn}$ may generate fluctuation in one or more parameters of electrical activity in electrical coils of actuator 38 and/or actuator 54.

The amplitude of load fluctuations in drive system 30 may change as control system 50 adjusts the operation of vibratory mechanism 28 to change the amplitude of fluctuation in the net vertical force $F_{vn}$. For example, the amplitude of load fluctuations in drive system 30 may increase abruptly when the amplitude of fluctuation in the net vertical force $F_{vn}$ becomes large enough to cause base 14 to separate from surface 12. After base 14 separates from surface 12, the impact when base 14 falls back to surface 12 may jolt weights 32, 34, which may generate a spike in the loads in drive system 30, including the load on actuator 54.

Additionally, the time pattern of load fluctuations in drive system 30 may depend on the amplitude of the fluctuating net vertical force $F_{vn}$. Loads in drive system 30 may fluctuate during each cycle of the fluctuating net vertical force $F_{vn}$ (i.e. at the excitation frequency), regardless of the amplitude of the fluctuating net vertical force $F_{vn}$. However, some amplitudes of the fluctuating net vertical force $F_{vn}$ may result in larger amplitude load fluctuations in drive system 30 during some cycles than during other cycles.

For example, amplitudes of the fluctuating net vertical force $F_{vn}$ high enough to cause double jumping may produce such a result. During double jumping, the load fluctuations occurring in drive system 30 at the excitation frequency may include relatively large amplitude fluctuations during those cycles when base 14 impacts surface 12 and significantly smaller amplitude fluctuations during the alternate cycles when base 14 is in the air. In mathematical terms, load fluctuations in drive system 30 during double jumping may include a relatively large amplitude component at half the excitation frequency and a significantly smaller amplitude component at the excitation frequency.

In contrast, when the fluctuating net vertical force $F_{vn}$ has an amplitude low enough that base 14 remains in continuous contact with surface 12, loads in drive system 30 may fluctuate approximately the same amount during each cycle of the fluctuating net vertical force $F_{vn}$. Accordingly, under such circumstances, the amplitude of load fluctuations in drive system 30 at half the excitation frequency may not differ significantly from the amplitude of load fluctuations at the excitation frequency.

Figure 2:
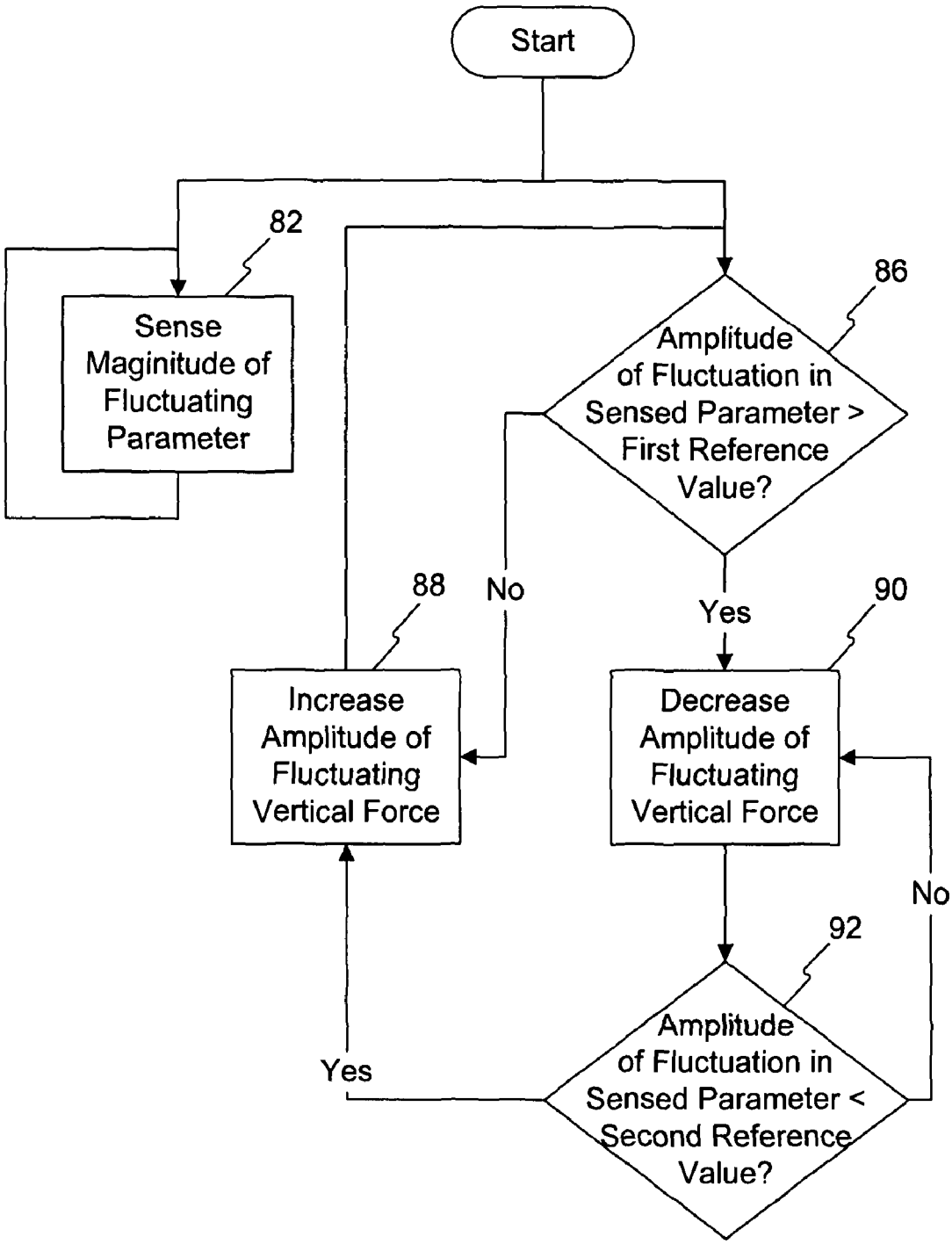
FIG. 2 is a flow chart illustrating one embodiment of a control method according to the present disclosure.

Control system 50 may capitalize on the operating characteristics discussed above with a control method that involves automatically adjusting the operation of vibratory mechanism 28 based at least in part on a fluctuating load or a related parameter of the operation of vibratory mechanism 28. FIG. 2 illustrates one embodiment of such a control method. In this method, control system 50 may sense the magnitude of a fluctuating parameter (step 82). For example, as mentioned above, sensors 80, 81 may collectively sense the load on actuator 54. Simultaneously, control system 50 may determine whether the amplitude of fluctuation in the sensed parameter exceeds a first reference value (step 86). For example, controller 76 may process the signals from sensors 80, 81 to determine whether the amplitude of the fluctuation in the load on actuator 54 exceeds the reference value. If the amplitude of the fluctuation in the sensed parameter does not exceed the reference value, control system 50 may adjust the operation of vibratory mechanism 28 to increase the amplitude of the fluctuating net vertical force $F_{vn}$ (step 88). Control system 50 may continue doing so until the amplitude of the fluctuation in the sensed parameter does exceed the first reference value (step 86).

When the amplitude of fluctuation in the sensed parameter exceeds the first reference value, control system 50 may adjust the operation of vibratory mechanism 28 to decrease the amplitude of the fluctuating net vertical force $F_{vn}$ (step 90). Control system 50 may then determine whether the amplitude of fluctuation in the sensed parameter has dropped below a second reference value (step 92). If not, control system 50 may again adjust the operation of vibratory mechanism 28 to decrease the amplitude of the fluctuating net vertical force $F_{vn}$ (step 90). Once the amplitude of fluctuation in the sensed parameter falls below the second reference value (step 92), control system 50 may adjust the operation of vibratory mechanism 28 to increase the amplitude of the fluctuating net vertical force $F_{vn}$ (step 88). As before, control system 50 may continue doing so until the amplitude of fluctuation in the sensed parameter exceeds the first reference value (step 86).

Depending on the specific objective for implementing the control method shown in FIG. 2, control system 50 may use various values as the first reference value and the second reference value. Each reference value may have a fixed value, or control system 50 may determine the reference value as a function of one or more operating parameters. In some embodiments, the first reference value may substantially correspond to an amplitude of fluctuation in the sensed parameter that occurs when the amplitude of the fluctuating net vertical force $F_{nv}$ becomes large enough to cause base 14 to separate from and fall back to surface 12. Such a value may be determined empirically. By using such a value as the first reference value in the control method shown in FIG. 2, control system 50 may enhance compaction of surface 12 by keeping the amplitude of the fluctuating net vertical force $F_{nv}$ high while keeping base 14 on surface 12 a high percentage of the time.

Strategies for automatically adjusting the operation of vibratory mechanism 28 based on one or more operating parameters are not limited to the examples discussed in connection with FIG. 2. For example, control system 50 may implement a control strategy that involves comparing the amplitude of fluctuation in the sensed parameter to fewer or more reference values to determine whether and which way to adjust the amplitude of the fluctuating net vertical force $F_{vn}$. Additionally, in combination with, or in place of, using the first and second reference values as triggers for adjusting operation of vibratory mechanism 28, control system 50 may implement various other types of control strategies based at least in part on the sensed parameter. For example, control system 50 may control vibratory mechanism 28 based on lookup tables, equations, or similar means that define one or more desired relationships between the sensed parameter and one or more parameters of the operation of vibratory mechanism 28. Furthermore, in some embodiments, control system 50 may implement a control strategy that involves controlling vibratory mechanism 28 based on one or more particular frequency components of the sensed parameter.

Figure 3:
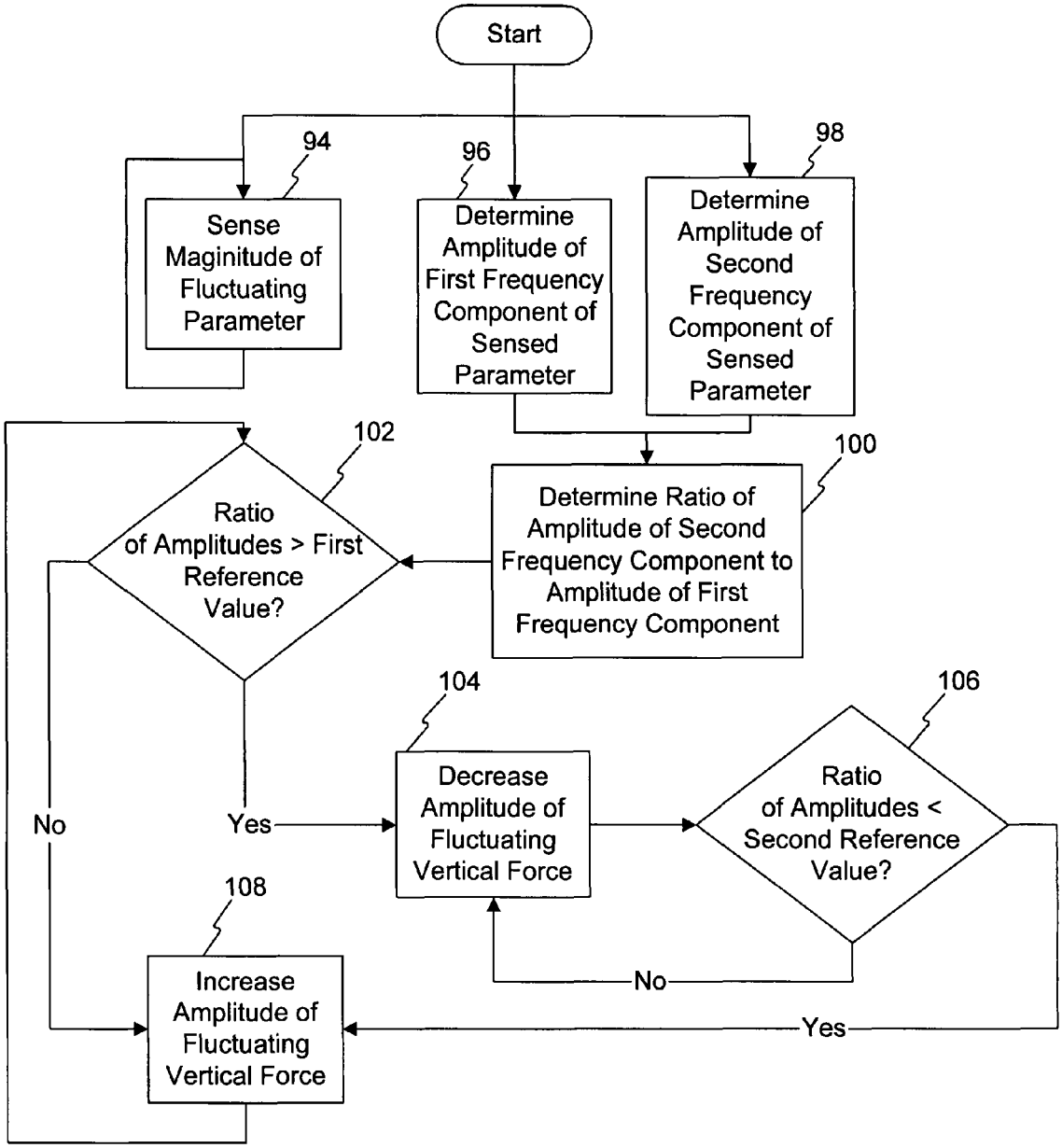
FIG. 3 is a flow chart illustrating another embodiment of a control method according to the present disclosure.

FIG. 3 illustrates one embodiment of such a control method. In this control method, control system 50 may sense the magnitude of a fluctuating parameter (step 94). For example, as discussed above, sensors 80, 81 may collectively sense the load on actuator 54 and indicate it to controller 76.

Simultaneously, control system 50 may determine the amplitude of a first frequency component of the sensed parameter (step 96). For example, controller 76 may determine the amplitude of the component of the sensed parameter at the excitation frequency. Control system 50 may also determine the amplitude of a second frequency component of the sensed parameter (step 98). For example, controller 76 may determine the amplitude of the component of the sensed parameter at half the excitation frequency. Control system 50 may use any suitable signal-processing technique to determine the amplitudes of the first and second frequency components of the sensed parameter. After determining the amplitude of the first and second frequency components of the sensed parameter, control system 50 may determine the ratio of the amplitude of the second frequency component to the amplitude of the first frequency component (step 100).

Control system 50 may employ the ratio of the amplitude of the second frequency component to the amplitude of the first frequency component in various ways to achieve various objectives. In some embodiments, control system 50 may determine whether the ratio exceeds a first reference value (step 102) and, if so, adjust the operation of vibratory mechanism 28 to decrease the magnitude of the fluctuating net vertical force $F_{vn}$ (step 104). Control system 50 may use various values as the first reference value. The first reference value may have a fixed value, or control system 50 may define the first reference value as a function of one or more operating conditions of surface compactor 10. In some embodiments, the first reference value may substantially correspond to a ratio of the amplitudes of the first and second frequency components that occurs when surface compactor 10 begins double jumping. By employing this value as a trigger for reducing the magnitude of the fluctuating net vertical force $F_{vn}$, control system 50 may minimize or eliminate double jumping.

After reducing the amplitude of the fluctuating net vertical force (step 104), control system 50 may determine whether the ratio of the amplitude of the second frequency component to the amplitude of the first frequency component has dropped below a second reference value (step 106). If not, control system 50 may again adjust the operation of vibratory mechanism 28 to reduce the magnitude of the fluctuating net vertical force $F_{vn}$ (step 104). Once the ratio falls below the second reference value (step 106), control system 50 may begin adjusting the operation of vibratory mechanism 28 to increase the magnitude of the fluctuating net vertical force $F_{vn}$ (step 108). Control system 50 may continue doing so until the ratio of the amplitude of the second frequency component to the amplitude of the first frequency component again exceeds the first reference value (step 102).

Control system 50 may use various values as the second reference value. The second reference value may have a fixed value, or control system 50 may define the second reference value as a function of one or more operating conditions of surface compactor 10.

Control strategies that involve controlling vibratory mechanism 28 based on one or more particular frequency components of the sensed parameter are not limited to the examples provided above. For example, control system 50 may control vibratory mechanism 28 based on two frequency components of the sensed parameter other than the component at the excitation frequency and the component at half the excitation frequency. Additionally, control system 50 may control vibratory mechanism 28 based on more than or less than two frequency components of the sensed parameter. Furthermore, in addition to, or in place of, using the first and second reference values as triggers for adjusting operation of vibratory mechanism 28, control system 50 may implement various other types of control strategies based at least in part on one or more frequency components of the sensed parameter. For example, control system 50 may control vibratory mechanism 28 based on lookup tables, equations, or similar means that define desired relationships between one or more particular frequency components of the sensed parameter and one or more parameters of the operation of vibratory mechanism 28.

Additionally, the general operation of surface compactor 10 is not limited to the examples discussed above. For example, rather than sensing the magnitude of the load on actuator 54, control system 50 may sense the magnitude of some other parameter of the operation of vibratory mechanism 28 that fluctuates in reaction to vibratory mechanism 28 generating the fluctuating net vertical force $F_{vn}$. Similarly, in place of sensing a parameter of the operation of vibratory mechanism 28, control system 50 may sense a load that fluctuates in some other portion of surface compactor 10 in reaction to vibratory mechanism 28 generating the fluctuating net vertical force $F_{vn}$. Furthermore, in embodiments where vibratory mechanism 28 generates the fluctuating net vertical force $F_{vn}$ in a manner other than by rotating weights 32, 34 around axis 36, control system 50 may use a different approach to adjust the amplitude of the fluctuating net vertical force $F_{vn}$.

The disclosed embodiments may enable surface compactor 10 to perform highly effectively with relatively low cost components. As discussed above, control system 50 may achieve various performance advantages by automatically adjusting one or more aspects of the operation of vibratory mechanism 28 based on one or more parameters of operation that fluctuate in reaction to vibratory mechanism 28 generating the fluctuating net vertical force $F_{vn}$. Additionally, using parameters such as those discussed above as the basis for adjusting the operation of vibratory mechanism 28 may allow use of relatively low-cost sensing methods.

It will be apparent to those skilled in the art that various modifications and variations can be made in the surface compactor and methods without departing from the scope of the disclosure. Other embodiments of the disclosed surface compactor and methods will be apparent to those skilled in the art from consideration of the specification and practice of the surface compactor and methods disclosed herein. It is intended that the specification and examples be considered as exemplary only, with a true scope of the disclosure being indicated by the following claims and their equivalents.

What is claimed is:

1. A surface compactor, comprising:

a base;

a vibratory mechanism, including a drive system that moves at least two weights in a manner that generates a fluctuating vertical force on the base, the drive system including an actuator to move the weights relative to one another to change a net centrifugal force generated by the weights as the weights rotate; and a control system that senses a load in the surface compactor that fluctuates in reaction to the drive system moving the one or more weights and generating the fluctuating vertical force, wherein the control system adjusts the operation of the vibratory mechanism to adjust the fluctuating vertical force based at least in part on the sensed load, wherein the control system includes a sensor adapted to sense the load in the surface compactor, the load being on an actuator.

2. The surface compactor of claim 1, wherein:

the actuator is a fluid-operated actuator; and the sensor is a pressure sensor adapted to sense pressure in the operating fluid for the actuator.

3. The surface compactor of claim 1, wherein the actuator is part of the vibratory mechanism.

4. A method of operating a surface compactor, the method comprising:

supporting a base of the surface compactor on a surface;

generating a fluctuating vertical force on the base with a vibratory mechanism, including moving one or more weights of the vibratory mechanism with a drive system of the vibratory mechanism;

sensing a load on an actuator of the drive system of the vibratory mechanism; and adjusting the operation of the vibratory mechanism to reduce the magnitude of the fluctuating vertical force in response to the sensed load fluctuating by an amount greater than a reference value.

5. The method of claim 4, wherein adjusting the operation of the vibratory mechanism to reduce the magnitude of the fluctuating vertical force includes activating the actuator to adjust the relative position between two or more components of the vibratory mechanism.

6. The method of claim 4, wherein:

the actuator is a fluid-operated actuator; and sensing a load on the actuator includes sensing pressure in the operating fluid for the actuator.

7. The method of claim 4, wherein the reference value substantially corresponds to an amplitude of fluctuation in the sensed load that occurs when the amplitude of the fluctuating vertical force becomes large enough to cause the base to separate from the surface.

* * * * *